US005472116A

United States Patent [19]

Barbe et al.

[11] Patent Number: 5,472,116

[45] Date of Patent: Dec. 5, 1995

[54] APPARATUS FOR SELECTING AND DISPENSING A SERVICE AGAINST PAYMENT

[75] Inventors: Serge Barbe; Thierry Brusseaux; Didier Lehoux, all of Besancon, France

[73] Assignee: Schlumberger Industries, Montrouge, France

[21] Appl. No.: 245,008

[22] Filed: May 18, 1994

[30] Foreign Application Priority Data

May 19, 1993 [FR] France ..... 93 06031

[51] Int. Cl.[6] ..... G07F 11/00

[52] U.S. Cl. ..... 221/126; 221/2; 221/5; 221/70; 221/133

[58] Field of Search ..... 221/126, 2, 5, 221/8, 70, 133, 135; 340/825.35; 200/564, 566

[56] References Cited

U.S. PATENT DOCUMENTS

| | | | |
|---|---|---|---|
| 911,968 | 2/1909 | Freas | 200/566 X |
| 983,045 | 1/1911 | Gossman et al. | 221/126 |
| 2,191,585 | 2/1940 | Pulver | 221/126 X |
| 2,669,611 | 2/1954 | Silvius | 200/564 X |
| 3,061,143 | 10/1962 | Simjian | 221/126 X |
| 3,156,340 | 11/1964 | Arkes | 221/126 X |
| 3,184,557 | 5/1965 | Clarey | 200/566 X |
| 3,534,185 | 10/1970 | Knapton et al. | 200/564 X |

*Primary Examiner*—William E. Terrell
*Assistant Examiner*—Dean A. Reichard
*Attorney, Agent, or Firm*—Frishauf, Holtz, Goodman, Langer & Chick

[57] ABSTRACT

Apparatus for dispensing a service against payment. Values of at least a first set of parameters are displayed for determining the service, and a single control member is adapted, firstly, to allow selection of the desired value for the parameter and, secondly, to confirm the choice which has been made.

7 Claims, 4 Drawing Sheets

APPARATUS FOR SELECTING AND DISPENSING A SERVICE AGAINST PAYMENT

FIELD OF THE INVENTION

The present invention concerns apparatus for dispensing a service such as a travel ticket against payment in cash or by credit card, for example. The apparatus of the invention also enables the user to choose a desired service, from among various possible choices, depending on various parameters, each of which can take several values.

BACKGROUND OF THE INVENTION

In the example of a dispenser for travel tickets, the user selects a desired ticket depending, for example, on the destination, on the rate, and on whether it is one way or both ways. Such automatic dispensers are becoming widespread and are made necessary by the increasing number of passengers and the tendency to cut down on ticket offices which require a lot of staff. In the application of the invention to dispensers for tickets, such dispensers need to fulfill many and varied and often contradictory conditions, such as are recited below, without limitation thereto.

These apparatuses should be capable of withstanding the conditions to which they are subjected in the environment in which they are located, in general outdoors and without shelter. This results in vulnerability to vandalism and also to the rigors of the weather (wind, rain and dust).

It is also important that the time taken to select and dispense the ticket be as brief as possible. Waiting in front of a machine is generally poorly tolerated by users standing in front of the apparatus while it is working, even less so by the potential users waiting in line.

Another feature which the dispenser should have is "user-friendliness" which term covers ease of use and the absence of a time-consuming need to learn details of how to operate it.

Furthermore, the user should be able to select, confirm and pay the corresponding amount in a minimum number of operations.

For ticket selection, the user finds it valuable to remain in control of the selections made and, in particular, the order in which parameters are selected, and also being able to return, by "backtracking" in the case of error, without mistakes leading to the user abandoning the transaction or, (if this prolongs the transaction because of the slowness of the apparatus or lack of user-friendliness), causing the potential users standing in line to become impatient and complain.

However, from the point of view of the operator, the dispensers should have flexibility of use, that is to say they should provide a large number of parameters, capable of taking a very large number of values, especially in the case of destinations (which may number up to 100 for example). It is also desirable to issue different tickets without increasing the complexity of the operations. Further, the presentation of the information given to the user to make a choice should be compatible with the practices of the operator, whether from the point of view of standards, colors or use of logos or pictograms.

In addition, dispensers are required to be usable by any kind of individual, regardless of sex, age, height or any other criterion. Likewise, it is important for the apparatus to be capable of use regardless of the viewing angle or the position of the user relative to the apparatus, without the user being obliged to get into a specific position relative thereto, which is an unacceptable constraint in commercial terms.

Known dispensers rely on various means of presenting information to enable a user to make a choice and means for confirming the choice made, that is to say to initiate monitoring of the payment made and the dispensing of the chosen ticket.

Dispensers with a touch screen may be cited as an example. These suffer from a major disadvantage, namely their relative fragility and vulnerability, whether to vandalism attacks or environmental factors. Attempts have been made to remedy this disadvantage by placing a sheet of protective, polycarbonate material over such touch screens at around 3 cm from the screen. However, this spacing leads to parallax, which greatly reduces the readability of the screen and forces a restriction on the number of items of information that can be placed on the screen if it is desired that it is to be capable of being read by persons of different height for example.

A second known type of dispenser comprises a screen carrying certain information relating to tickets. Confirmation or selection is effected with the aid of keys placed at the sides and corresponding to each zone of the screen. That device has the disadvantage of being limited physically by the number of keys which can be placed alongside the screen and, consequently, of being limited as to the number of items of information which can be displayed. Also, the relative locations of the screen zones and the corresponding keys does not allow precise alignment, which makes it necessary to provide optical arrangements to allow the user to mentally associate the screen zone containing the selected information and the corresponding key.

There are also dispensers comprising a front face provided with an array of keys each corresponding to a destination, other sets of keys being provided for the other parameters (class, rate, etc.). With more than a few parameter values, i.e. more than a few destinations, that type of device is extremely difficult to use. Thus, to allow a large choice of destinations, the array of keys may contain up to 600 keys which results in a "wall" effect in front of the user. In spite of arranging the keys in alphabetical order for example, the search for the chosen destination is very slow. Moreover, the user has to back off from this large array, which makes it necessary to re-approach the apparatus to effect other operations, such as selection of the class or type of travel, not to mention the payment itself. It takes an extremely long time to get familiar with such apparatuses. Moreover, even when the user is familiarized, the time needed to effect all of the operations of selection, confirmation and payment remains a lot higher than the standards generally allowed. Moreover, that type of presentation of information necessary for the user to make the choice involves selecting the parameters in a given sequence. In other words, the user has to learn the operation of the apparatus in a first interval of time, for example from pictograms or numbers indicating the sequence of operations, before even starting the actual operations for selection.

Other types of apparatus have been proposed comprising keyboards allowing alphanumeric values to be entered in correspondence with a pre-established code, each code corresponding to a given value of a parameter. However, that type of apparatus requires a relatively long period of learning and familiarization. Above all, that type of apparatus takes an inherently simple operation, which is simply conceived in the mind of the user, namely determining the destination or the type of travel, and transforms it into a complex, abstract mental operation which requires the simple, intuitive information to be converted into a series of abstract codes. Moreover, the use of a keyboard both involves a significant loss of time, which increases the length of the transaction, and also requires the user to take the eyes off the display panel containing the information in order to enter the corresponding code. Such decomposition of successive operations further increases the time taken by the transaction.

SUMMARY OF THE INVENTION

The present invention is aimed at overcoming the disadvantages mentioned above and to provide a device enabling the user to select a service and have it dispensed (for example a travel ticket) in a rapid and user-friendly manner, without preliminary learning and regardless of sex, age, height, intellect and physical position in front of the apparatus.

To this end, according to the invention, the device for dispensing a service against payment comprises means for displaying values of at least a first set of parameters determining the service and a single control member adapted, firstly, to allow selection of the desired value for the parameter and, secondly, to confirm the choice which is made, in order to control a mechanism for dispensing the requested service, after payment has been made.

The apparatus preferably comprises a screen, and the single control member is a knob mounted to rotate in a plane parallel to the screen.

The knob is advantageously provided with a push-button adapted to effect the confirmation operation. The push-button is preferably in the center of the knob.

The values of each parameter are displayed in columns, for example, and the screen also displays additional information, the confirmation of which triggers the display of a second set of parameters on the screen.

BRIEF DESCRIPTION OF THE DRAWINGS

The invention will be better understood in the light of the following description of an embodiment of the invention, referring to the accompanying drawings, in which.

MORE DETAILED DESCRIPTION

The invention will be described below as it applies to a dispenser of travel tickets.

Figure 1:
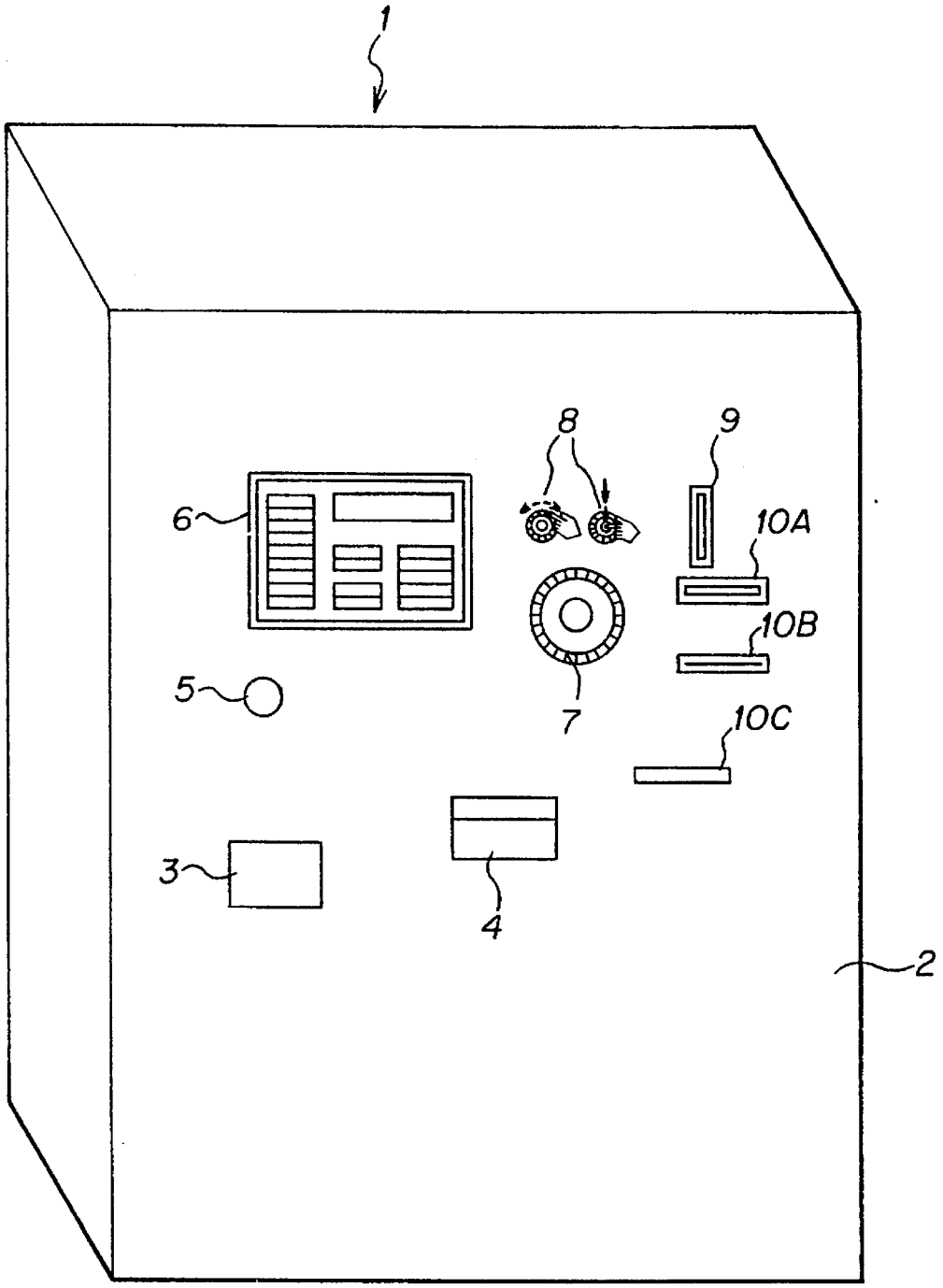
FIG. 1 is a schematic perspective view of a ticket dispenser.

FIG. 1 shows a dispenser, illustrated schematically in the form of a rectangular block with the reference 1 and comprising a front face 2 accessible to the public. A change tray 3, a slot 4 for dispensing travel tickets, a cancel key 5, a screen 6, a control member 7, explanatory pictograms 8, slots 9, 10A and 10B for inserting money, tickets and credit or other cards respectively, and a return slot 10C in case of cancellation are all provided in the front face 2.

The user wishing to have a ticket dispensed operates the control member 7 in order to choose among the values given on the screen 6 that which suits him, doing this for each parameter, with a view to being issued with the corresponding type of service. The user confirms the chosen values, parameter by parameter, and pays the corresponding amount, also displayed on the screen 6, by inserting coins in the slot 9 or by inserting a card (credit or payment) in the slot 10A or 10B.

Inside, the dispenser 1 has a central unit 22 (FIG. 3) and checking, control and operating means known per se and adapted to allow verification of the inserted coins or credit card, then printing the ticket in dependence on the information received from the central unit, which is connected firstly to the control means 7 and the screen 6 so as to issue the appropriate ticket and then to command a printer 24 which issues a ticket to the user through the opening 4. In case of overpayment, the apparatus also includes means for calculating the necessary change and for delivering the change to the tray 3. The specific details of the means recited above are not shown and are known per se in respect of the central unit 22 and the means for verifying the payment, printing the ticket and giving change.

Figure 2:
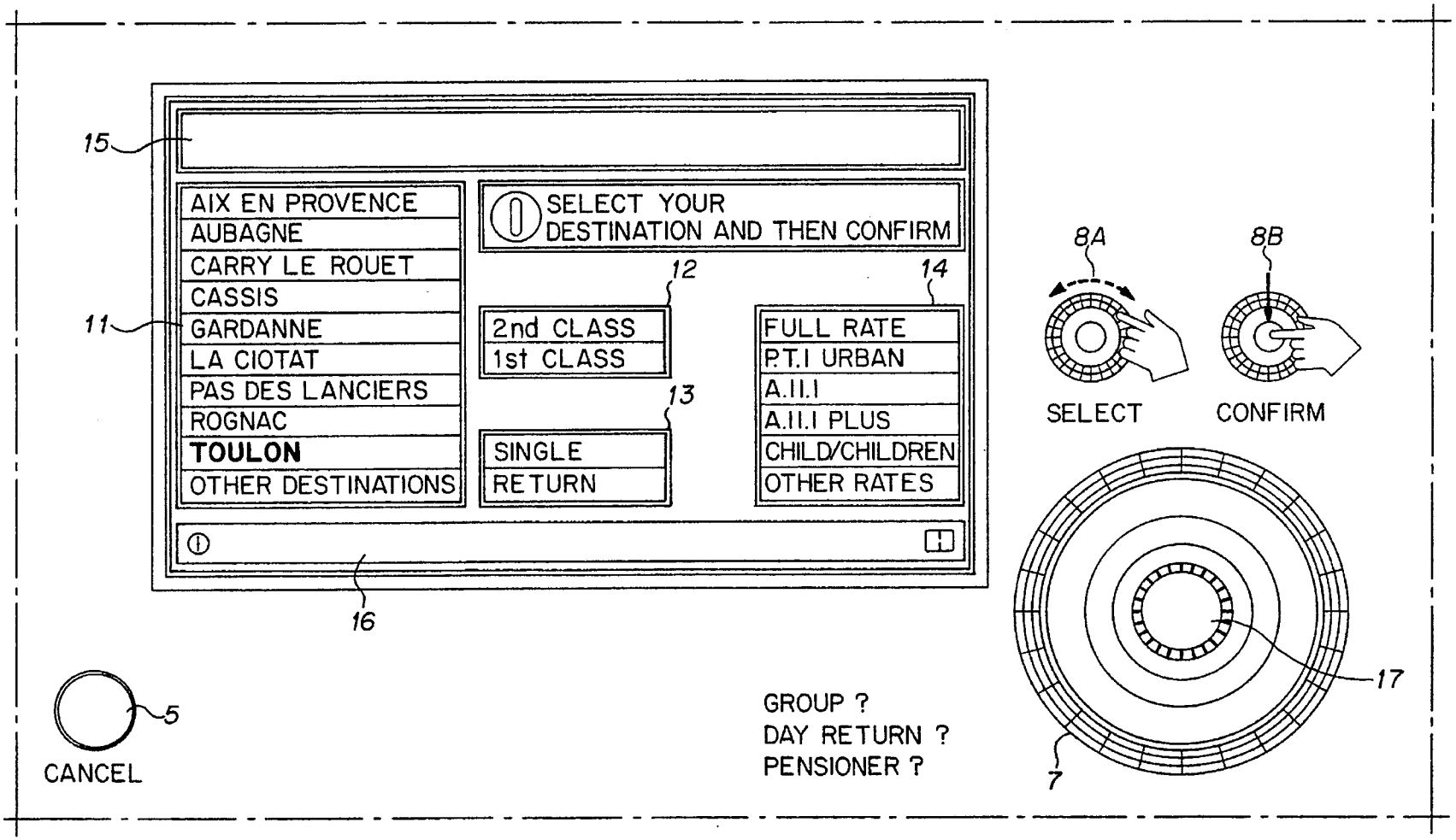
FIG. 2 is a detailed view of the screen and the single control member.

FIG. 2 shows in more detail the means for displaying information allowing the user to determine the desired ticket.

The screen 6 has a series of items of information arranged in columns in the example shown, each column corresponding to a parameter. Each parameter can take several values. In the example shown, a first column 11 corresponds to a series of possible destinations, a second column 12 corresponds to a class (first or second), while a third column 13 lists two values of a parameter relative to the type of ticket (single or return) and finally a column 14 lists the different rates applicable.

Other information can be displayed on the screen 6, such as the site of the dispenser (rectangle 15), i.e. the station of departure, and also the time, for example, or the date.

Another field 16, located in the lower part for example, is provided to display general information regarding payment, such as for example the coin amounts and the minimum payment by credit card, or a message of a commercial nature.

Situated alongside the screen 6 and close thereto is the control member 7, in the form of a knob mounted on the front face 2 of the dispenser to rotate about an axis perpendicular to the front face. The knob 7 can turn in a plane parallel to the front face and to the plane of the screen 6. The pictogram 8A shows that the knob 7 can be rotated in one direction or the other.

The knob 7 also comprises a central button with the reference 17 and which the user can push, as is shown by the pictogram 8B.

Referring to FIG. 2, the use of the device by the user and especially the use of the screen and of the control member is as follows:

The screen has a cursor in the form of a highlighted band corresponding to one value of one of the parameters. By way of example and as shown in FIG. 2, one of the destinations (Toulon) is highlighted relative to the others. Commencing from this operating state, the user turns the knob one way or the other to move the cursor in the column 11 listing the various destinations. Thus, by turning the knob counter-clockwise, the cursor is shifted down within the column 11 and in the example shown it reaches an "other destinations" message, for example, while starting from the representation in FIG. 2, turning the knob clockwise causes the highlighted cursor to move up. The user continues with this movement until the highlighted cursor reaches the desired destination.

The user then proceeds to confirm the destination by pressing the central button 17, as shown in the pictogram 8B.

Selection of class, corresponding to the table 12 having two rows is effected in the same manner, i.e. by moving the highlighted cursor. For example, starting from the representation of FIG. 2, the cursor is moved down by counterclockwise rotation of the knob 7 until the cursor reaches the bottom row of the block 11, and continued rotation of the knob causes the cursor to leave this block and go to the block 12, where the user having reached the chosen row (second class for example), confirms the choice by pressing the central button 17.

The same selection and confirmation operations apply to columns 13 and 14 corresponding to the type of ticket (single or return) and to the type of rate.

Once the selections and confirmations have been made, the user pays the amount corresponding to the service and the ticket is issued.

Figure 3:
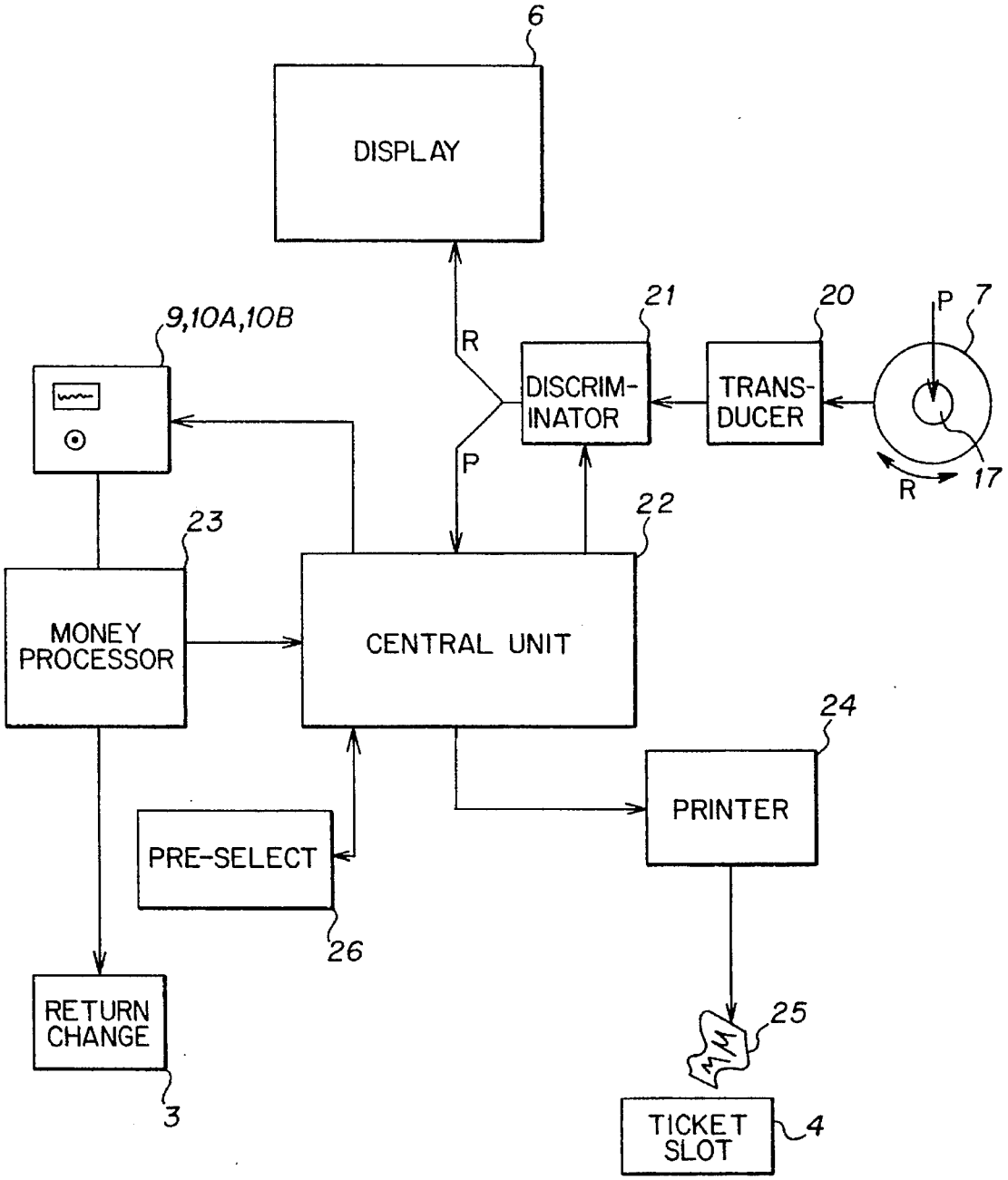
FIG. 3 is a simplified block diagram of the circuitry of the device.

Referring to FIG. 3, the means of the device enabling these operations to be carried out are outlined below.

The knob 7 is connected to a displacement transducer 20 which is connected to a functional unit 21 which distinguishes the rotary movement (R) of the knob 7 from the pressing movement (P) of the central confirming button 17. In the case of rotary movement, the unit 21 controls the screen to move the highlighted cursor in accordance with the direction of rotation. When pressure on the central button 17 is detected, the functional unit 21 acts on central unit 22 having several functions. On reception of the information in respect of which the central button 17 has been pressed (to confirm the choice in the corresponding column), the unit 22 acts on the unit 21 to allow possible renewed movement of the highlighted cursor on the screen, should the user follow successive confirmation operations by turning the knob.

Once the various operations of selection and confirmation have been effected in succession, the ticket is defined, and central unit 22 then commands opening of the insertion slots 9, 10A and 10B for the money or the payment card. The corresponding amount which is inserted is then processed by means 23 for processing money or a bank card and adapted to issue information on correct or incorrect payment to the central unit 22. In the case of payment adjudged to be correct, the central unit 22 commands printing means 24 to print a ticket 25, which will be passed to the opening 4 provided in the front face 2 of the dispenser. If change is to be returned, the processing means 23 are adapted to return the change to the tray 3. The unit 22 puts the dispenser in the ready state at the end of the operations and closes the openings 9, 10A and 10B for insertion of money and a bank card respectively. The apparatus is then ready to handle another transaction.

Still referring to FIG. 3, means are shown as a block 26 for determining and displaying on the screen a pre-selection or a combination of parameters corresponding to a travel ticket with given parameters. This preselection is useful when, statistically speaking, a large number of tickets are issued and sold for a single destination, at a given rate, and for the same type of ticket. This may be the case for example for practical reasons, such as an event attracting a large number of persons, or features relating to the local customers (return of a population of military on Friday evening), or any other practical reason. This preselection by the block 26 is pre-established by the operator in dependence on available information. This preselection can be made in dependence on statistical studies established in advance but it can equally well be modified in statistical manner on the basis of transactions over a greater or lesser period of time. The preselection block 26 is thus adapted to receive all information from the unit 22 relating to the set of transactions performed over a period of time, in order to be able to process this information statistically and possibly modify the preselection which is provided.

The preselection is presented to the user as four highlighted cursors, each corresponding to a respective value of the four respective parameters defining a travel ticket. A user who is one of the population wanting such a ticket, merely has to confirm it by the single operation of pressing the central button 17. This represents an appreciable saving of time.

Figure 4:
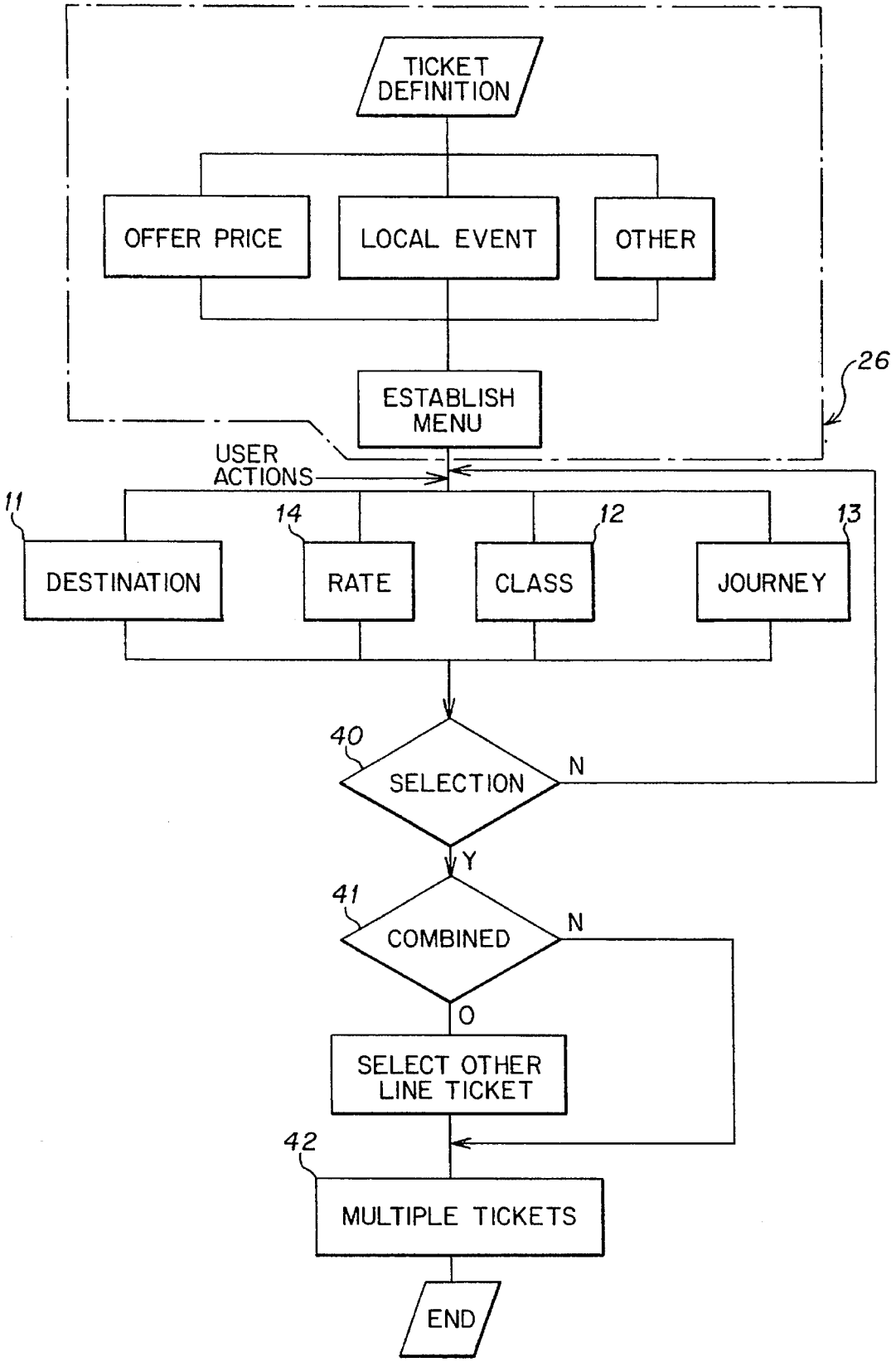
FIG. 4 is a flow-chart of the operation of the device.

The preselection block 26 is shown in the flow chart of FIG. 4 described below in detail.

The four parameters, destination, rate, class and single/return are obtained, which leads to a functional block 40 adapted to determine whether selection has ended or not, i.e. whether all the parameters have actually been defined by a respective value for each of them. If not, the user is invited to continue operations of selection and confirmation, in the manner described above.

If selection is complete, another option is offered to the user in the form referred to as "combined mode" (block 41) offering the user a combined ticket of urban type for example together with the already-selected main line or suburban ticket. Another option (block 42) is also offered in the form of multiple tickets, i.e. purchase of a group of several tickets of the same type by the same user.

These sub-options are optional and can be omitted in some cases and for apparatuses where design, price and usage are low.

It will be understood that the invention makes it possible for the average user to understand the operation of the apparatus, to select four successive parameters and to operate the successive confirmations, without any preliminary learning and in an extremely short time, in the order of some seconds (in the order of around five seconds maximum).

Among the numerous advantages of the invention the following are cited by way of example.

The uniqueness of the control member for the selection and confirmation makes it possible to restrict the number of operations needed and, thus, to reduce the total time of the transaction, and equally leads to a simplification appreciated by users. The fact that one highly user-friendly member is used, such as a rotary knob for example, makes it possible substantially to do away with any learning period. In a few seconds at the most, any user or the majority of them are capable of understanding the operation. It is equally noteworthy that the mode of operation is capable of being shown on the front face of the apparatus (pictograms 8A and 8B) in an extremely simple and vivid manner which can be understood by the majority of users in a relatively short time. This user-friendliness and simplicity also involve a supplementary advantage, namely that the user manipulates the knob in an intuitive way and thus can make selections without taking the eyes off the screen. This is extremely important to the extent that it enables the user to proceed to the different successive operations without interrupting rhythm and with great ease, which takes away a certain stress in the operations of selection, compared with the prior art.

Once the user has grasped how to operate the device, it quickly becomes clear that the movement of the cursor as a function of the movement of the knob is always the same. Since this can only turn in one direction or the other, the movement of the cursor can only take place in one direction or the other. This simplicity of movement allows the user to locate a request, and the various acts of selection and confirmation in the full sequence. Thus, the user can predict at any instant where the cursor will be found as a result of the movement of the knob.

The screen allows the set of items of information needed for the selection of a travel ticket to be displayed in a minimum area.

The apparatus also comprises additional means allowing these advantageous features to be reinforced.

For example, the highlight can be retained in each column corresponding to a parameter whose parameter value has been confirmed. Thus, the user can see from a simple glance the set of parameters that have already been confirmed at any instant and can also verify which of them remain to be selected and confirmed.

The amount of information presented to the user is very small, since the screen and the knob are small in size, and this enhances ergonomic qualities as well as intuitive handling, as mentioned previously.

Note that the cancel key 5 is separate and made noticeable, for example by a bright color, which allows rapid access in case of difficulty or a change of mind of the user. This is reassuring from the psychological point of view.

Other options are also possible: for example such an apparatus allows the ticket to be punched just before it is issued through the opening 4. Likewise, in the case of the proposed preselection, it is conceivable to allow the preselection to be modified remotely, using a telephone network for example.

The display can be improved by adding a special zone of the screen where a message or several different messages can be displayed in dependence on certain operations or at the end of each operation, such as for example a message of a commercial nature (welcome, thanks, etc.).

The great simplicity of the device allows high resistance to external forces, whether of the environment or vandalism.

The invention is not limited to the embodiment shown and described but, on the contrary, encompasses all variants that fall within the scope of the following claims.

We claim:

1. Apparatus for dispensing a service against payment of an amount, comprising:

means for displaying values of at least a first set of a plurality of parameters determining said service, a single control member for use in common to all said parameters, said single control member being adapted, for each parameter, firstly to allow selection of a desired value for said parameter and secondly to confirm the selection which is made, and means for dispensing said service after selection and confirmation of the value selected for each parameter of said set of parameters and after payment of said amount.

2. Apparatus according to claim 1, further comprising a display means formed by a screen, and wherein said single control member comprises a knob mounted to rotate in a plane substantially parallel to the screen.

3. Apparatus according to claim 2, wherein said knob is provided with a push-button adapted to effect the confirmation operation.

4. Apparatus according to claim 1, wherein the values of each parameter are displayed in columns.

5. Apparatus according to claim 1, comprising means for displaying additional information, wherein confirmation of said additional information triggers display of a second set of parameters which does not correspond to said additional information.

6. Apparatus according to claim 1, comprising automatic means for preselection of a given value of each parameter.

7. Apparatus according to claim 6, wherein said preselection can be modified.

* * * * *